US007824208B2

(12) United States Patent
Crofoot et al.

(10) Patent No.: US 7,824,208 B2
(45) Date of Patent: Nov. 2, 2010

(54) ELECTRICAL CABLE CONNECTOR LATCH MECHANISM

(75) Inventors: Larry M. Crofoot, Perry, OH (US); John T. Venaleck, Painesville, OH (US)

(73) Assignee: Ohio Associated Enterprises, LLC, Painesville, OH (US)

( * ) Notice: Subject to any disclaimer, the term of this patent is extended or adjusted under 35 U.S.C. 154(b) by 0 days.

(21) Appl. No.: 12/718,406

(22) Filed: Mar. 5, 2010

(65) Prior Publication Data

US 2010/0248522 A1 Sep. 30, 2010

Related U.S. Application Data

(60) Provisional application No. 61/163,135, filed on Mar. 25, 2009.

(51) Int. Cl.
*H01R 13/62* (2006.01)

(52) U.S. Cl. ..... 439/352

(58) Field of Classification Search ..... 439/352, 439/357, 358, 180
See application file for complete search history.

(56) References Cited

U.S. PATENT DOCUMENTS

| | | | | |
|---|---|---|---|---|
| 4,954,097 | A | 9/1990 | Sekiguchi | |
| 4,961,711 | A | 10/1990 | Fujiura et al. | |
| 5,082,455 | A | 1/1992 | Wei | |
| 5,154,629 | A | 10/1992 | Carver et al. | |
| 5,564,939 | A | 10/1996 | Maitani et al. | |
| 5,637,010 | A | 6/1997 | Jost et al. | |
| 6,517,373 | B2 | 2/2003 | Finke et al. | |
| 6,702,602 | B2 | 3/2004 | Wu | |
| 6,866,542 | B2 | 3/2005 | Murayama | |
| 6,953,356 | B2 | 10/2005 | Hisamatsu et al. | |
| 6,953,361 | B2 | 10/2005 | Li et al. | |
| 7,001,200 | B2 | 2/2006 | Yoshie | |
| 7,008,253 | B2 | 3/2006 | Szczesny | |
| 7,402,070 | B1 | 7/2008 | Wu | |
| 7,445,485 | B1 | 11/2008 | Wu | |
| 7,484,989 | B2 | 2/2009 | Venaleck | |
| 7,544,080 | B2 * | 6/2009 | Giefers | 439/352 |
| 7,549,886 | B2 * | 6/2009 | Herring et al. | 439/352 |
| 2005/0112920 | A1 | 5/2005 | Venaleck et al. | |
| 2009/0246999 | A1 | 10/2009 | Crofoot et al. | |

* cited by examiner

*Primary Examiner*—Gary F. Paumen
(74) *Attorney, Agent, or Firm*—Renner, Otto, Boisselle & Sklar, LLP

(57) ABSTRACT

An electrical cable connector has a latch mechanism wherein the moveable portion is part of the mating receptacle, and the mechanism for unlatching resides in the cable connector. A rocker part is located such that one end extends under the resilient latch member and the other end has a surface which is made to rotate about a pivot point by an externally actuated ramp. The rotation of the rocker lifts the resilient member from its seat and releases the connector latch. The actuating ramp is spring loaded to return to its resting position which is the latched position; it is attached to a loop designed to allow a finger pull action to initiate latch disengagement. Forces and friction resistance is managed such that reliable single-hand operation is achieved, with push to engage and pull to disengage.

21 Claims, 7 Drawing Sheets

ELECTRICAL CABLE CONNECTOR LATCH MECHANISM

The application claims priority under 35 USC 119 to U.S. Provisional Application No. 61/163,135, filed Mar. 25, 2009, which is incorporated herein by reference in its entirety.

BACKGROUND OF THE INVENTION

1. Field of the Invention

The invention is in the field of electrical connectors, and more particularly in the field of latches for electrical connectors such as cable connectors.

2. Description of the Related Art

In the field of cable connectors, many types of latches meant to retain the cable in the mating connector have been used. Two basic types are in popular use today: a) a thumbscrew or jackscrew type; and b) a snap latch or lateral spring-loaded latch type.

In the thumbscrew or jackscrew type an actual screw is used to secure the connector or to disengage it. This type has the advantage that once engaged, the attachment is ridged and will easily support hanging cables and other external loads. It will be appreciated that movement of the connector from external loads is undesirable. If the connector is of very fine pitch, small movement can cause electrical problems.

A snap latch or lateral spring-loaded latch activates automatically when the connector is installed. Release is usually accomplished by a separate member that defeats the spring-loaded latch. This type has a latch that has a small overtravel in order to allow the lateral spring latch to engage. This over-travel fundamental to its operation can be fairly large in order to account for manufacturing tolerance and various source suppliers. The overlap is essentially an axial looseness that would allow external forces (i.e., hanging cables or the like) to move or change the position of the connector.

Improvements would be desirable in the field of latching mechanisms for cable connectors.

SUMMARY OF THE INVENTION

According to an aspect of the invention, a latching mechanism for an electrical connector involves a spring member as part of the receptacle to secure its mating connector.

According to another aspect of the invention, an electrical connector latch mechanism uses a rocker element to disengage the receptacle latch member.

According to yet another aspect of the invention, the rocker element is actuated by a ramp element, the movement of which is facilitated by a finger-pull loop.

According to a further aspect of the invention, an electrical connector includes a backshell and a latch mechanism. The latch mechanism includes a rocker that is pivotal in the backshell member, and a ramp actuator with a loop pull feature, slideable in the backshell. The slideable ramp member is spring loaded to the latch position by at least one spring, the first side of which bears against the ramp member and the second side which bears against the backshell. The movement of the ramp slideable member inside of the backshell selectively compresses and expands the axial spring. The sliding motion of the ramp member causes the rotation of the rocker member such that the latch will be released when the loop in the ramp member is pulled against the spring load.

According to a still further aspect of the invention, an electrical coupling includes: a pair of electrical connectors that mate with each other; wherein the coupling may include one or more of the following features: a latch mechanism that works with a simple push-pull operation allowing single-operation engagement by pushing and single-operation disengagement by pulling; a latch mechanism in which tilting of a rocker part is used to disengage the latch; a loop that includes an actuator ramp that is used to tilt a rocker member; a loop that is spring-biased to prevent disengagement of a latch mechanism except when the loop is pulled; a loop that includes a return ramp used to prevent tilting of a rocker part except when the loop is pulled; a molded plastic loop having a pull section, and a head that is within a backshell of one of the connectors; a rocker part in one of the connectors that tilts to press against and resiliently deform part of the other connector, to disengage the latch mechanism; a rocker part that includes a forked end with a pair of fingers, wherein the fingers lift on opposite sides of an anchor when the rocker part is tilted; and a thinned section of a pull loop that allows easy flexing of the loop.

According to another aspect of the invention, an electrical coupling includes: a first electrical connector and a second electrical connector that mate with each other and are secured by a latch mechanism. The latch mechanism includes: an anchor on the first connector that fits into an opening in a receiver on the second connector; and a part on the first connector is configured to selectively move at least part of the receiver to disengage the anchor from the opening.

According to yet another aspect of the invention, an electrical coupling includes: a first electrical connector and a second electrical connector that mate with each other and are secured by a latch mechanism. The latch mechanism includes: an anchor on the first connector that fits into an opening in a receiver on the second connector; and a rocker on the first connector is configured to selectively tilt to deform the receiver to disengage the anchor from the opening.

According to still another aspect of the invention, an electrical coupling includes: a first electrical connector and a second electrical connector that mate with each other and are secured by a latch mechanism. The latch mechanism includes an anchor and a loop that are parts of the first connector, and a receiver of the second connector that has an opening therein. Pressing the connectors together causes deformation of the receiver to allow the anchor to enter into the opening, thereby engaging the connectors and locking the connectors together. Pulling the loop causes deformation of the receiver, allowing the anchor to be released from the opening and the connectors to be disengaged from each other.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

The annexed drawings, which are not necessarily to scale, show various features of the invention.

DETAILED DESCRIPTION

An electrical cable connector has a latch mechanism wherein the moveable portion is part of the mating receptacle, and the mechanism for unlatching resides in the cable connector. A rocker part is located such that one end extends under the resilient latch member and the other end has a surface which is made to rotate about a pivot point by an externally actuated ramp. The rotation of the rocker lifts the resilient member from its seat and releases the connector latch. The actuating ramp is spring loaded to return to its resting position which is the latched position; it is attached to a loop designed to allow a finger pull action to initiate latch disengagement. Forces and friction resistance is managed such that reliable single-hand operation is achieved, with push to engage and pull to disengage.

Figure 1:
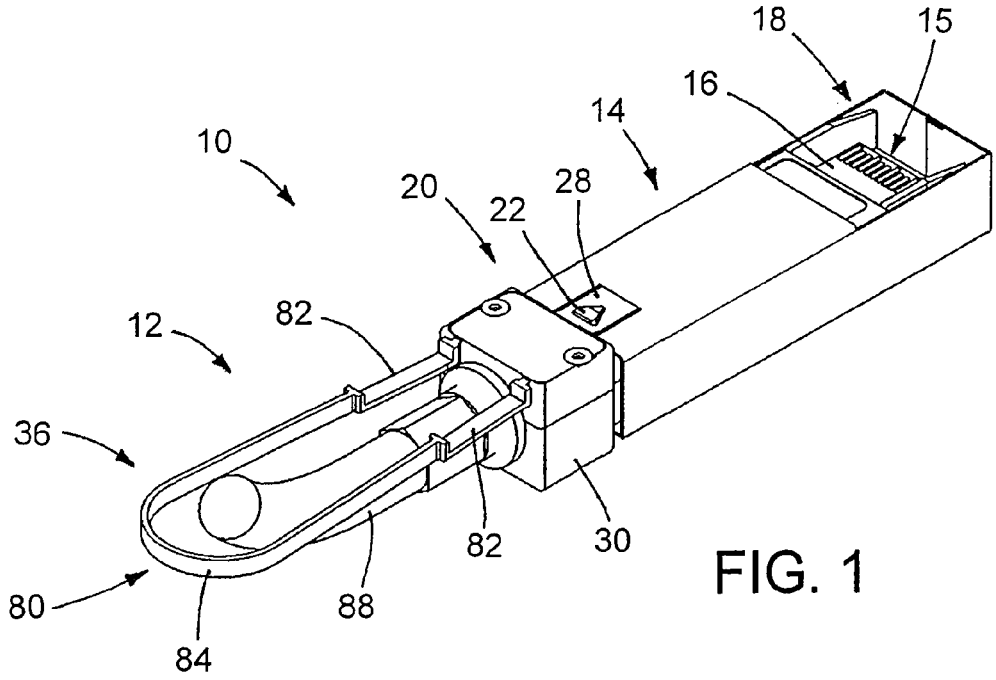
FIG. 1 is an oblique view of an electrical coupling of the present invention.
Figure 2:
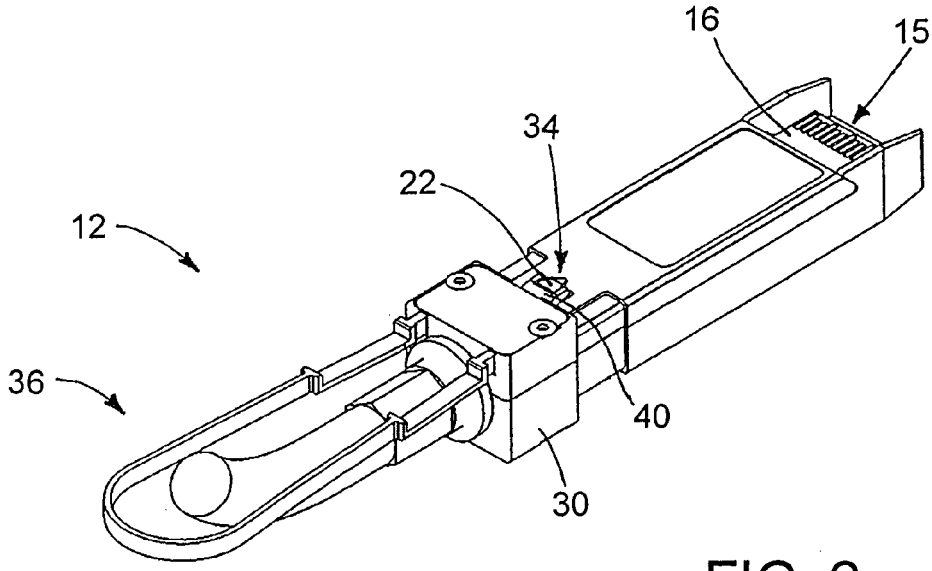
FIG. 2 is an oblique view of the male electrical connector of the electrical coupling of FIG. 1.
Figure 3:
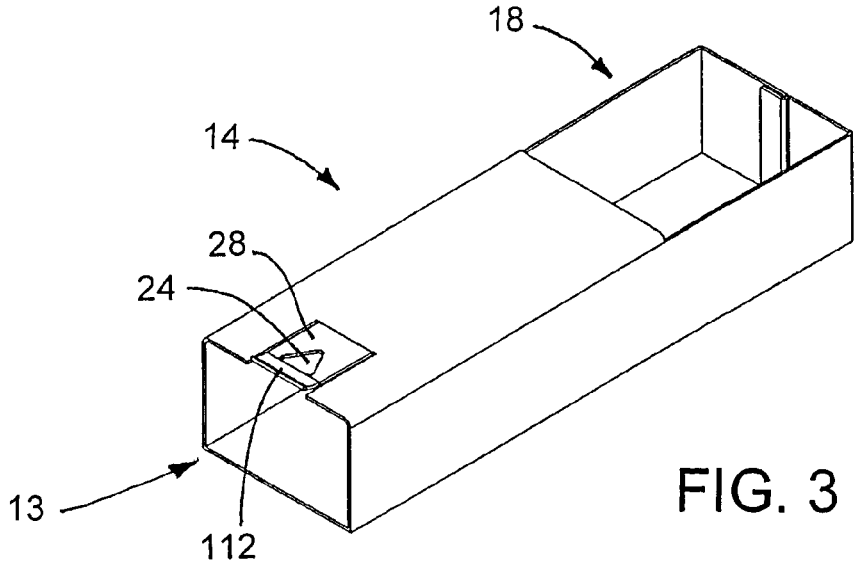
FIG. 3 is an oblique view of a female receptacle of the electrical coupling of FIG. 1.

FIGS. 1-3 shows a mated electrical coupling 10 (FIG. 1) in which a male electrical connector (first connector or cable connector) 12 (FIG. 2) engages a female receptacle (second connector) 14 (FIG. 3), when the male electrical connector 12 is inserted into an insertion opening 13 of the receptacle 14. The male electrical connector 12 fits into the receptacle 14, and is held in place by a latching mechanism 20. In this condition contacts 15 on a connector circuit board 16 of the male connector 12 are accessible through a window 17 in the female receptacle 14. The male connector circuit board 16 may have the contacts 15 on both its upper and lower surfaces. The connector circuit board 16 may engage a receptacle mating part (not shown in FIGS. 1-3) that is located inside the receptacle 14. The latching mechanism 20 includes an anchor 22 on the connector 12 that engages an opening 24 in a receiver 28 of the receptacle 14. The anchor 22 is a protrusion that protrudes from an upper surface of a backshell 30 of the connector 12. Both the anchor 22 and the backshell 30 may be made of metal, for instance zinc, aluminum or steel. The receptacle 14 may also be made of suitable metal, with the receiver 28 perhaps being a compliant tab that may be selectively elastically bent relative to the rest of the receptacle 14. When the latching mechanism 20 is engaged, the anchor 22 fits into the opening 24 of the receiver 28. In this condition the receiver 28 rests on a seat 34 of the connector 12, a part of the top surface of the backshell 30 that surrounds the anchor 22.

The connector 12 has a disengagement mechanism that is used to disengage the latching mechanism 20. The disengagement mechanism includes a plastic loop 36 that is pulled to cause a rocker part 40 to tilt upward. The rocker part 40 lifts the receiver 28 off of the seat 34 and out of engagement with the anchor 22, disengaging the latch mechanism 20. The connector 12 may be removed from the receptacle 14, for instance using the same pulling that is used to disengage the latch mechanism 20.

Figure 4:
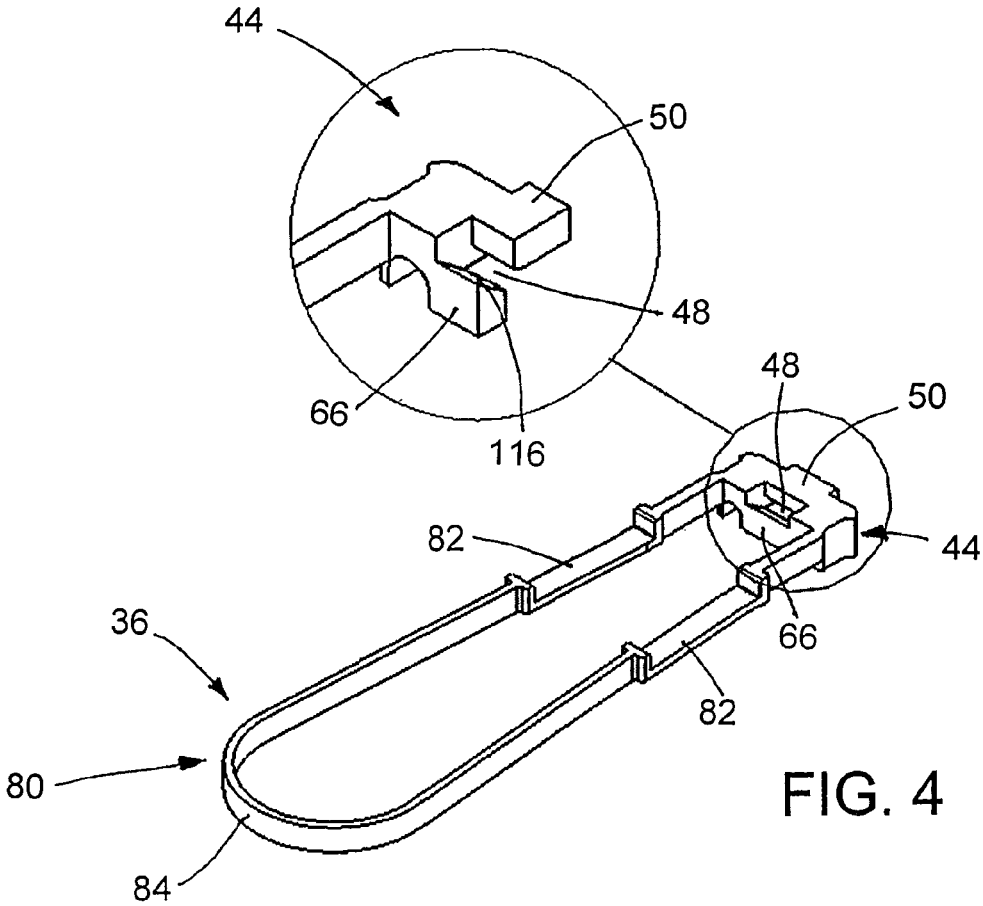
FIG. 4 is an oblique view of the loop of the male electrical connection of FIG. 2, with an insert showing detail on part of the loop.
Figure 5:
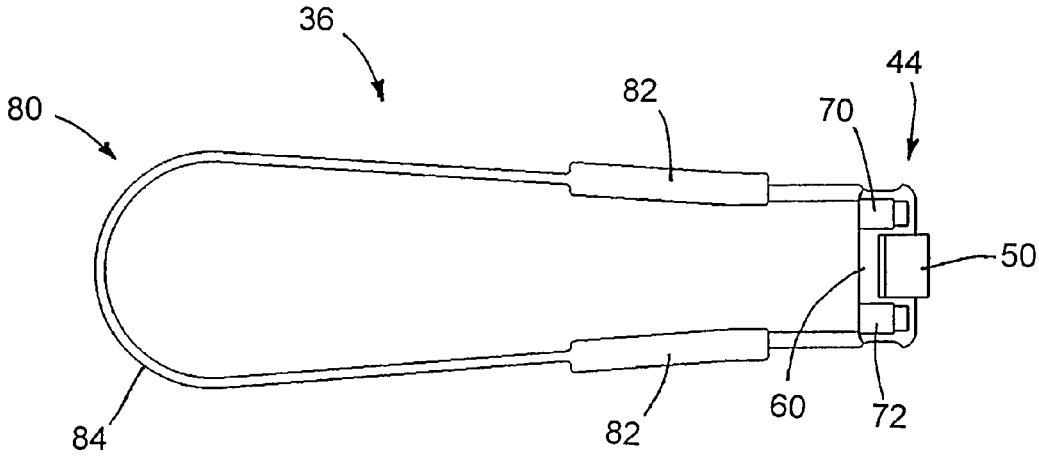
FIG. 5 is a plan view of the loop of FIG. 4.
Figure 6:
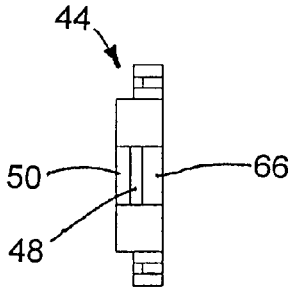
FIG. 6 is an end view of the loop of FIG. 4.

What follows are more details given to supplement the above summary. With reference in addition to FIGS. 4-6, the pull or plastic loop 36 is a molded plastic part that has a head 44 that fits inside the backshell 30, to come into contact with the rocker part 40. The loop 36 is used to press against portions of the rocker part 40 to cause the rocker part 40 to be selectively tilted to disengage the latching mechanism 20.

Figure 7:
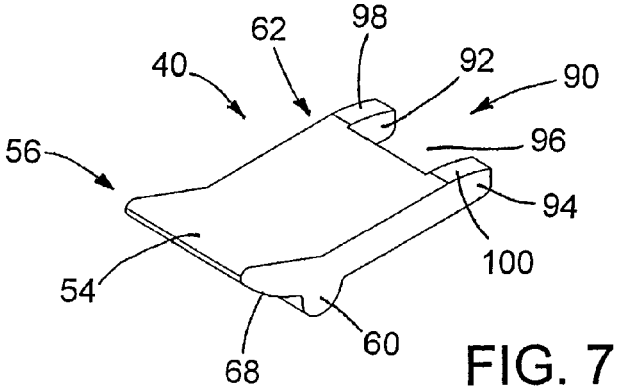
FIG. 7 is an oblique view of a rocker of the loop of the male electrical connection of FIG. 2.

Referring now also to FIG. 7 for details of the rocker part 40, the loop head 44 has a slot 48 for receiving in it part of the rocker part 40. Above and forward of the slot 48 is a central actuating ramp 50 that is used to selectively press against an upper surface 54 of one arm 56 of the rocker part 40. When the actuating ramp 50 pressed against the rocker arm upper surface 54, the arm 56 is pressed down. This causes the rocker part 40 to pivot about its central curved portion 60, raising the other arm 62 of the rocker part 40.

Below and behind the slot 48 is a return ramp 66. The return ramp 66 presses against a lower surface 68 of the rocker arm 56, and is used to secure the rocker part 40 in place when the latch mechanism 20 is engaged.

The rocker part 40 may be made of any of a variety of suitable materials, such as a suitable metal or plastic. The rocker part 40 may be a molded or cast part, for example.

The loop head 44 also has a pair of slots 70 and 72 (FIG. 5) on its underside. The slots 70 and 72 receive springs that are used to spring bias the position of the loop 36 when there is no pulling force on the loop 36 that overcomes the spring forces. Unless the spring force is overcome the loop 36 is positioned with the return ramp 66 pressing against the rocker arm lower surface 68.

The loop 36 has a strap portion 80 that forms a U shape, running from one side of the back of the head 44 around to the other side of the back of the head 44. The strap 80 has a thinned portion 82 near the head 44, which is thinner in a vertical direction than a pull portion 84 that is gripped to pull on the loop 36. The thinner portion 82 allows for flexibility of the loop 36, to permit bending of the loop 36 up and down. This permits the loop 36 to be easily positioned in a variety of ways relative to a cable 88 (FIG. 1) that enters the backshell 30. The cable 88 can either pass over the pull portion 84 or under the pull portion 84. Electrical conductors (wires) of the cable 88 can be coupled to the contact traces 15 (FIG. 1) on the male connector circuit board 16 (FIG. 1), such as by being soldered to the conductive traces 15.

The loop 36 may be formed as a single continuous piece of molded plastic. It will be appreciated that any of a variety of suitable thermoplastics, such as nylon, may be used.

Referencing now again FIG. 7, the rocker arm 62 has a forked end 90 that has a pair of fingers 92 and 94 on either side of a central open space 96. The fingers 92 and 94 are configured to engage the receiver 28 (FIG. 3) on either side of the seat 34 (FIG. 3) to selectively disengage the receiver 28 from the anchor 22 (FIG. 1) when the rocker part 40 is tilted. The fingers 92 and 94 have sloped engagement ends 98 and 100 for pushing against the bottom surface of the receiver 28.

Figure 8:
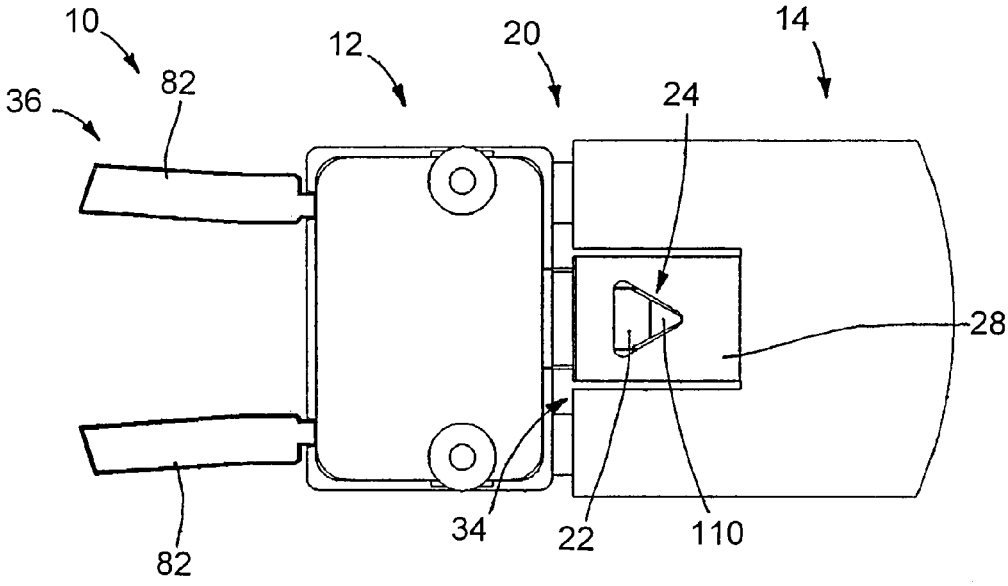
FIG. 8 is a top view of part of the electrical coupling of FIG. 1.
Figure 9:
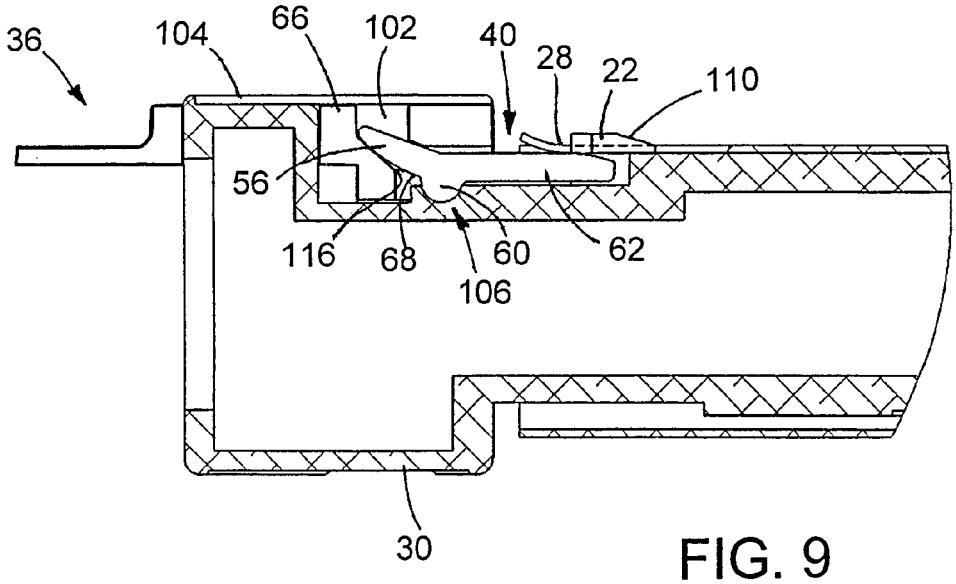
FIG. 9 is a side cross-sectional view of part of the electrical coupling of FIG. 1, showing engagement of the male electrical connector and the female receptacle.
Figure 10:
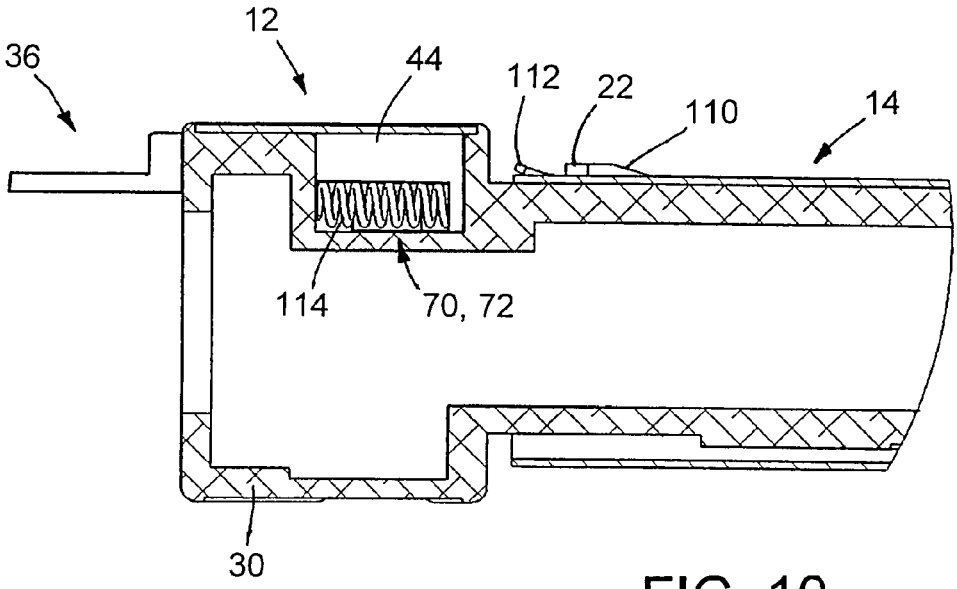
FIG. 10 is another side cross-sectional view of part of the electrical coupling of FIG. 1, with engagement of the male electrical connector and the female receptacle.

FIGS. 8-10 illustrate the latch mechanism 20 in its engaged configuration. The loop head 44 and part of the rocker part 40 are located in a cavity 102 within the backshell 30. The cavity 102 is closed off by a retainer cap 104 of the backshell 30. The rocker arm 56 and the rocker central part 60 are within the cavity 102, while the rocker arm 62 protrudes from the cavity 102. The rocker central part 60 is located in a notch 106 within the cavity 102, allowing the rocker part 40 to be able to pivot (tilt) about the curved rocker central part 60. The loop head 44 is able to slide back and forth within the cavity 102. This causes different parts of the loop head 44 to press against different surfaces 54 and 68 of the rocker arm 56, controlling tilting of the rocker part 40.

The engagement of the latching mechanism 20 commences with the insertion of the connector 12 into the receptacle 14. As the connector 12 is inserted into the receptacle 14, a sloped surface 110 of the anchor 22 comes into contact with an upturned end 112 of the receiver 28. The anchor 22 pushes the receiver tab 28 up and out of the way until the anchor 22 is aligned with the receiver opening 24. At that point the receiver 28 snaps down onto the seat 34 of the connector 12, securing the anchor 22 within the receiver opening 24. A pair of springs in the spring slots 70 and 72 (only one spring 114 is shown in FIG. 10) provide a force on the loop 36 that pushes the loop 36 forward within the loop head cavity 102. This causes a sloped surface 116 of the return ramp 66 to press against the bottom rocker arm surface 68. This keeps the rocker arm 62 from tilting upward, and thus keeps the rocker arm 62 from pushing upward against the receiver 28. This keeps the latch mechanism 20 in its engaged configuration.

Figure 11:
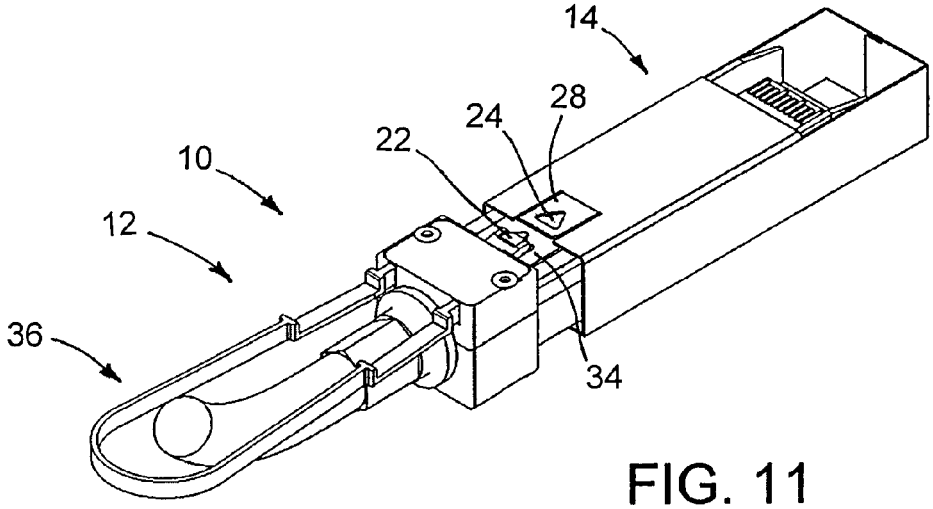
FIG. 11 is an oblique view of the electrical coupling of FIG. 1, with the male electrical connector partially engaged in the female receptacle.
Figure 12:
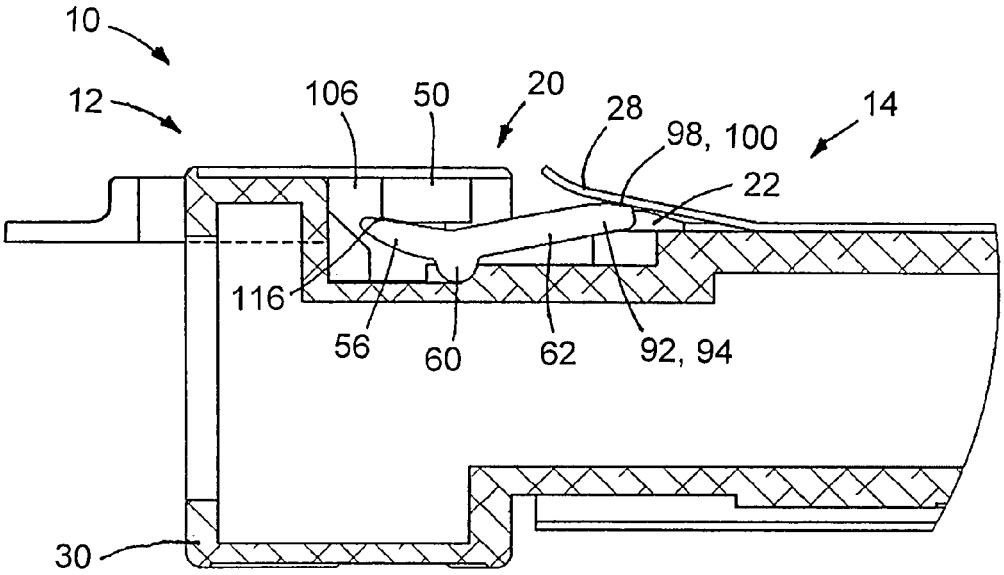
FIG. 12 is a side cross-sectional view of part of the electrical coupling of FIG. 1, showing disengagement of the male electrical connector from the female receptacle.
Figure 13:
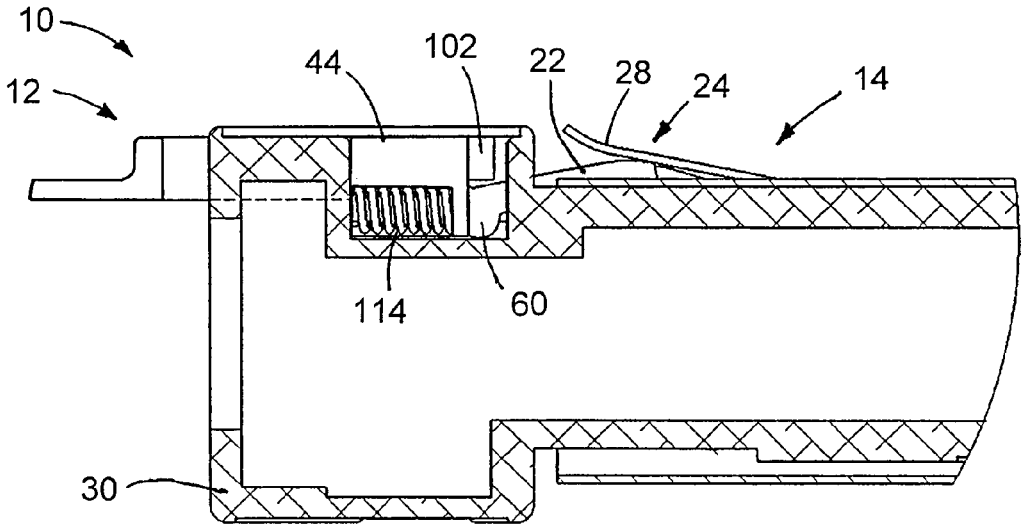
FIG. 13 is another side cross-sectional view of part of the electrical coupling of FIG. 1, showing another view of disengagement of the male electrical connector from the female receptacle.

With reference now to FIGS. 11-13, disengagement of the latch mechanism 20 is accomplished by simply pulling on the loop 36. This pulls the loop head 44 backward within the cavity 102, away from the receptacle 14, against the spring force of the springs (such as the spring 114), disengaging the return ramp 66 from the rocker part 40. The backward movement of the loop 36 also moves the actuating ramp 50 back, bringing the actuating ramp 50 into contact with the upper rocker arm surface 54. This pushes the rocker arm 56 downward, tilting the entire rocker part 40 about its central portion 60. The rocker arm 62 thus tilts upward, with the sloped engagement ends (surfaces) 98 and 100 of the fingers 92 and 94 coming into contact with the receiver 28, and resiliently pushing the receiver 28 upward. The upward bending of the receiver 28 disengages the receiver 28 from the anchor 22. Once the anchor 22 is out of the receiver opening 24 the latch mechanism 20 is disengaged, and there is no further resistance against removing the electrical connector 12 from the receptacle 14, such as by continued pulling on the loop 36.

The coupling 10 described above has many advantages, including operating by simple push and pull actions. The connector 12 is pushed into the receptacle 14 to push the connector 12 into coupling with the receptacle 14 and to engage the latching mechanism 20. The loop 36 is pulled to disengage the latching mechanism 20 and to separate the electrical connector 12 from the receptacle 14. The simple and intuitive push-to-engage-and-pull-to-disengage operation of the latch mechanism 20 provides a substantial advantage over latch mechanisms that operate in more complex and/or non-intuitive ways.

It will be appreciated that many aspects of the coupling 10 are omitted from the above discussion, or are discussed only briefly, as not relating to the operation of the latch mechanism 20. For example it will be appreciated that the electrical connector 12 includes an array of electrical contacts that engage corresponding electrical contacts within the receptacle 14.

It will be further appreciated that the coupling described herein is only one embodiment of a variety of possible embodiments. To give one example of a variant, it will be appreciated that the anchor 22 and the opening 24 may have any of a wide variety of suitable shapes beyond the triangular shapes shown in the figures. More broadly, it will be appreciated that aspects of the latching mechanism 20 described above with regard the connector 12 alternatively may be place on the receptacle 14, and vice versa. Broadly speaking the latching mechanism may include a resilient member on one of the connectors, and an engaging rigid or resilient member on the other of the connectors.

Figure 14:
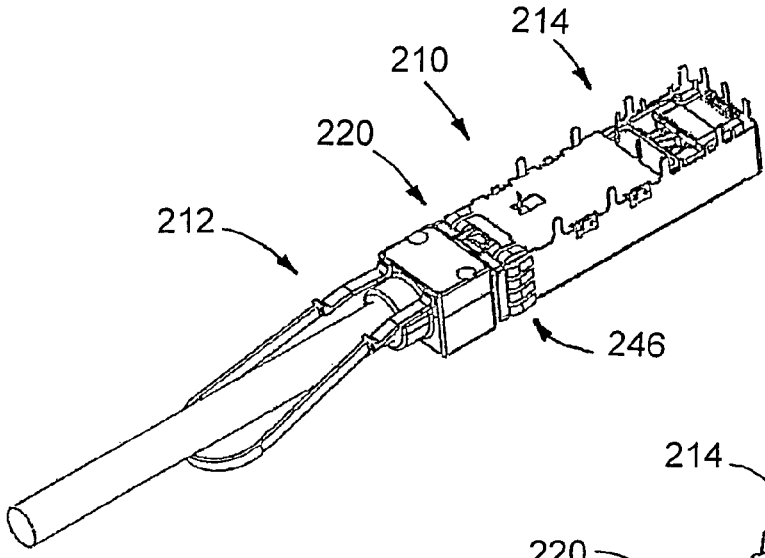
FIG. 14 is an oblique view of an alternate embodiment electrical coupling of the present invention.
Figure 15:
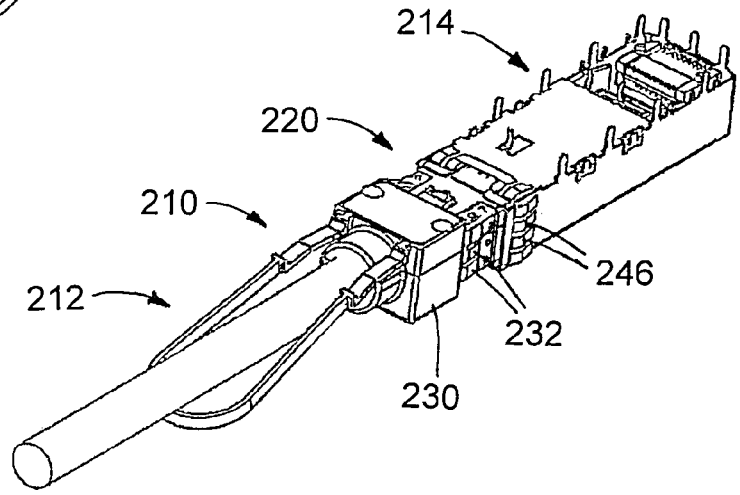
FIG. 15 is an oblique view of the electrical coupling of FIG. 14, with the male electrical connector partially engaged in the female receptacle.
Figure 16:
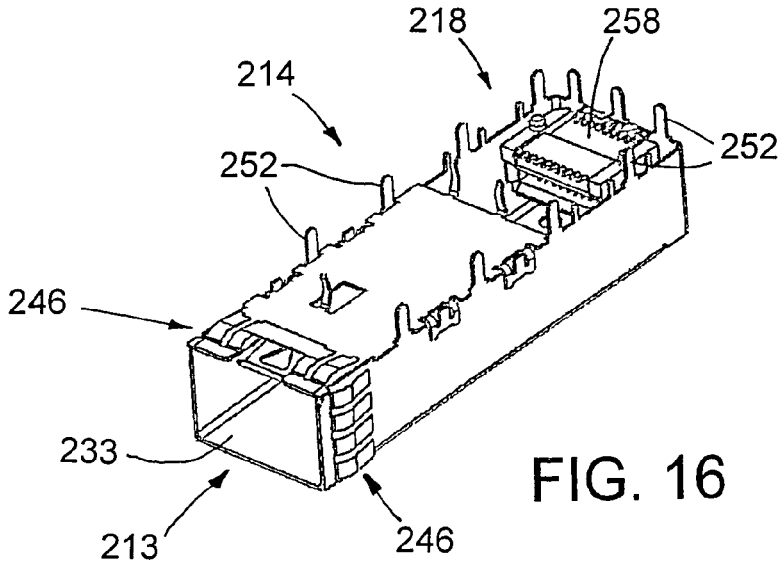
FIG. 16 is an oblique view of a female receptacle of the electrical coupling of FIG. 14.

FIGS. 14-16 show an alternate embodiment, an electrical coupling 210 with a male electrical connector 212 that may be secured to a female receptacle (connector) 214 through a latching mechanism 220. Many of the features of the coupling 210 are similar to corresponding features 10 (FIG. 1). It will be appreciated that some of these similar features may be omitted in the following discussion of the electrical coupling 210.

The male connector 212 includes a series of protrusions 232 on a backshell 230. The protrusions 232 may be outward bent metal tabs that press against an inner surface 233 of the female receptacle 214 when the male connector 212 is inserted into the receptacle 214. The protrusions 232 are located where they engage the inner surface of the receptacle 214 just inside an insertion opening 213 of the receptacle 214. In cooperation with the receptacle 214, the protrusions 232 aid in maintaining position of the connector 212 within the receptacle 214, and also provide some frictional resistance to engagement and disengagement of the connector 212 and the receptacle 214.

The receptacle 214 also may have folded-over tabs 246 on the outside of the receptacle 214, surrounding the insertion opening 213. The purpose of the tabs 246 may be to make an electrical connection to an exterior metallic panel to control (minimize) EMI emissions.

The receptacle 214 may be a board mount receptacle, capable of being attached to a circuit board. Toward that end the receptacle 214 may have a series of pins 252 for attaching the receptacle 214 to a circuit board (not shown), and/or for electrical connecting the receptacle 214 to conductive traces or other elements on the circuit board. The pins 252 may be placed in holes (vias) in the circuit board. Some or all of the pins 252 may have curved split elements that resiliently engage walls of the holes or vias. Alternatively or in addition, some or all of the pins 252 may enter into the circuit board holes without engaging sides of the holes. The receptacle 214 may be secured to the circuit board by soldering at least some of the pins 252 to the holes, or by securing the pins 252 by any of a variety of other suitable means.

The receptacle 214 may enclose a receptacle mating part 258 that is also secured to the circuit board, through a window 218 in the receptacle 214. The receptacle mating part 258 may be used for receiving a connector circuit board of the electrical connector 212 (not shown, but similar to the connector circuit board 16 shown in FIGS. 1 and 2).

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. An electrical coupling comprising:

a first electrical connector and a second electrical connector that mate with each other and are secured by a latch mechanism;

wherein the latch mechanism includes:

an anchor on the first connector that fits into an opening in a receiver on the second connector; and a part on the first connector is configured to selectively move at least part of the receiver to disengage the anchor from the opening.

2. The electrical coupling of claim 1, wherein the part is a rocker that selectively tilts to contact the receiver and move the at least part of the receiver.

3. The electrical coupling of claim 2, wherein the rocker has a forked end having a pair of fingers that define a central open space between the fingers; and wherein the anchor is located in the central open space between the fingers.

4. The electrical coupling of claim 2, wherein the first connector includes an actuating ramp that may be selectively moved to tilt the rocker to disengage the anchor from the opening.

5. The electrical coupling of claim 4, wherein the actuating ramp is part of a loop that has a strap portion that is pulled to selectively move the actuating ramp.

6. The electrical coupling of claim 5, wherein the actuating ramp and at least a portion of the rocker are within a cavity in a backshell of the first connector.

7. The electrical coupling of claim 4, wherein the loop includes a strap portion and a head; and wherein the actuating ramp is part of the head.

8. The electrical coupling of claim 7, wherein the loop is a molded plastic piece.

9. The electrical coupling of claim 7, wherein the strap portion includes a pull portion and a thinned portion;

wherein the strap portion has a U shape, and is configured to be gripped by a user in pulling the strap portion; and wherein the thinned portion is thinner than the strap portion.

10. The electrical coupling of claim 4, wherein the loop further includes a return ramp than is configured to press against the rocker to keep the rocker from disengaging the anchor from the opening.

11. The electrical coupling of claim 10, wherein the loop is spring-biased such that when there is no pulling force on the loop, the return ramp presses against the rocker to keep the rocker from disengaging the anchor from the opening.

12. The electrical coupling of claim 11, wherein the head has a pair of slots; and wherein springs located in the slots spring bias the loop.

13. The electrical coupling of claim 2, wherein the rocker is made of plastic.

14. The electrical coupling of claim 2, wherein the rocker is made of metal.

15. The electrical coupling of claim 1, wherein the part on the first connector is configured to resiliently deform the receiver to disengage the anchor from the opening.

16. The electrical coupling of claim 1, wherein the anchor has a triangular shape.

17. The electrical coupling of claim 1, wherein the anchor has a sloped engagement surface that resiliently deforms the receiver as the first connector is inserted into the second connector.

18. An electrical coupling comprising:

a first electrical connector and a second electrical connector that mate with each other and are secured by a latch mechanism;

wherein the latch mechanism includes:

an anchor on the first connector that fits into an opening in a receiver on the second connector; and a rocker on the first connector is configured to selectively tilt to deform the receiver to disengage the anchor from the opening.

19. The electrical coupling of claim 18, wherein the rocker has a forked end having a pair of fingers that define a central open space between the fingers;

wherein the anchor is located in the central open space between the fingers;

wherein the first connector includes an actuating ramp that may be selectively moved to tilt the rocker to disengage the anchor from the opening;

wherein the loop includes a strap portion and a head;

wherein the actuating ramp is part of the head;

wherein the strap portion is pulled to selectively move the actuating ramp;

wherein the actuating ramp and at least a portion of the rocker are within a cavity in a backshell of the first connector;

wherein the head further includes a return ramp than is configured to press against the rocker to keep the rocker from disengaging the anchor from the opening; and wherein the loop is a molded plastic piece.

20. The electrical coupling of claim 19, wherein the anchor has a triangular shape; and wherein the anchor has a sloped engagement surface that resiliently deforms the receiver as the first connector is inserted into the second connector.

21. An electrical coupling comprising:

a first electrical connector and a second electrical connector that mate with each other and are secured by a latch mechanism;

wherein the latch mechanism includes an anchor and a loop that are parts of the first connector, and a receiver of the second connector that has an opening therein; and wherein pressing the connectors together causes deformation of the receiver to allow the anchor to enter into the opening, thereby engaging the connectors and locking the connectors together; and wherein pulling the loop causes deformation of the receiver, allowing the anchor to be released from the opening and the connectors to be disengaged from each other.

* * * * *